United States Patent [19]

Lucas

[11] 4,035,980

[45] July 19, 1977

[54] METHOD OF PANEL RE-FACING BUILDING WALLS

[75] Inventor: Harold P. Lucas, Detroit, Mich.

[73] Assignee: Harold P. Lucas, Detroit, Mich.

[21] Appl. No.: 580,528

[22] Filed: May 23, 1975

[51] Int. Cl.[2] ..... E04G 11/00; E04F 13/00

[52] U.S. Cl. ..... 52/745; 52/747

[58] Field of Search ..... 52/717, 747, 479, 480, 52/509, 511, 506, 489, 202, 222, 460, 312, 745; 40/10 R, 16 R, 156

[56] References Cited

U.S. PATENT DOCUMENTS

| | | | |
|---|---|---|---|
| 555,097 | 2/1896 | Hurd | 52/509 |
| 777,334 | 12/1904 | Dieterich | 52/509 |
| 2,191,500 | 2/1940 | Rosling | 52/202 |
| 2,228,152 | 1/1941 | Patten | 52/747 |
| 2,298,743 | 10/1942 | Lichtor | 52/511 |
| 2,587,985 | 3/1952 | Elmendorf | 52/479 |
| 2,872,744 | 2/1959 | Dallen | 35/67 |
| 2,896,271 | 7/1959 | Kloote et al. | 52/747 |
| 2,947,093 | 8/1960 | Masters | 52/489 |
| 3,121,977 | 2/1964 | Bersudsky | 52/506 |
| 3,360,896 | 1/1968 | Wright | 52/489 |
| 3,458,963 | 8/1969 | Klein | 52/460 |
| 3,556,308 | 1/1971 | McAleenan | 35/65 |

FOREIGN PATENT DOCUMENTS

| | | | |
|---|---|---|---|
| 19,187 | 11/1891 | United Kingdom | 40/10 R |
| 20,567 | 9/1906 | United Kingdom | 40/10 R |

OTHER PUBLICATIONS

Weber Costello Publication, p. 14, dated Feb. 11, 1969.

*Primary Examiner*—James L. Ridgill, Jr.
*Attorney, Agent, or Firm*—Cullen, Settle, Sloman & Cantor

[57] ABSTRACT

The method of providing a new finish innerface on an existing vertical interior wall of a building or room which consists of the steps of securing mounting members along the upper and lower edges of the wall innerface and mounting one or more facing panels of solid free standing, substantial rigid material including securing its upper and lower edges with respect to the mounting members so as to firmly hold the rigid panel snugly against the wall face.

1 Claim, 10 Drawing Figures

FIG. 1
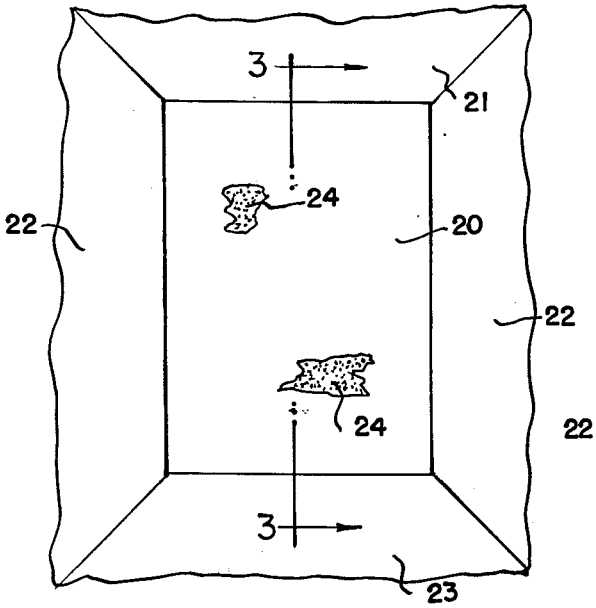
FIG. 2
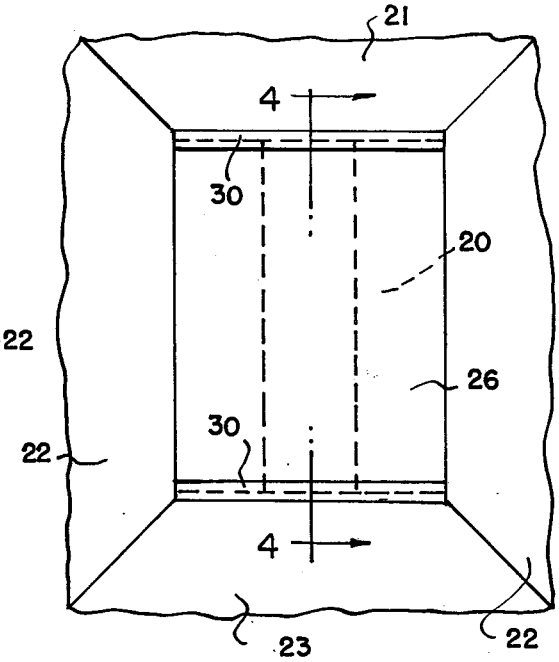
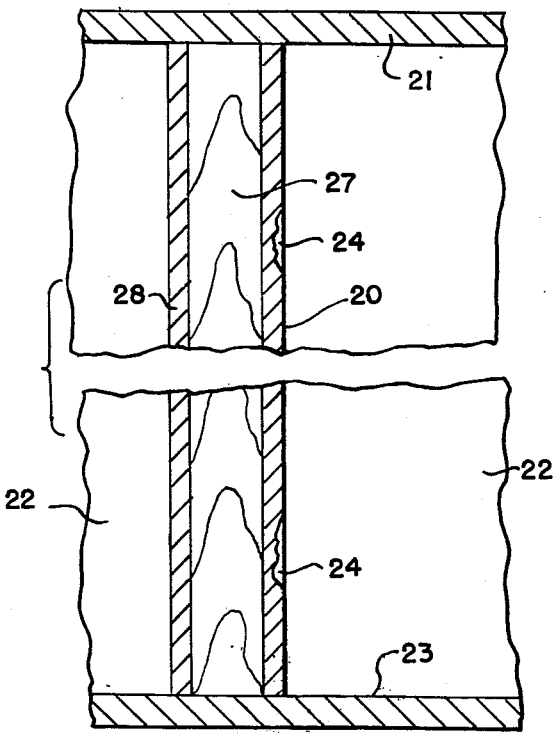
FIG. 3
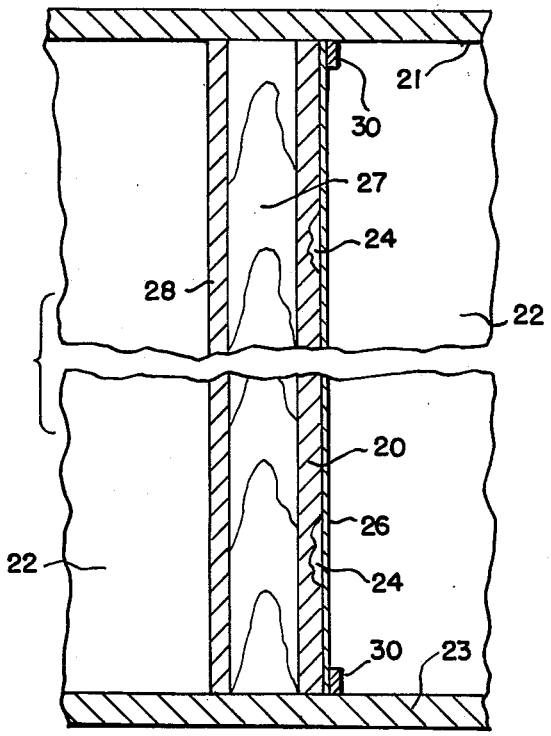
FIG. 4

METHOD OF PANEL RE-FACING BUILDING WALLS

BACKGROUND OF THE INVENTION

Heretofore, when a wall or the plaster thereof has been damaged or scratched or gouged or wherein it was desired to change the appearance thereof, such wall was resurfaced to repair damage and, thereafter a coat of paint or wallpaper applied thereto. The repairing, painting and/or wallpapering of a wall was long, tedious and expensive.

BRIEF DESCRIPTION OF THE INVENTION

The appended drawings disclose a basic method for finish facing an existing wall, particularly an inner vertical wall of a building or room, without painting or papering it, and without repairing or replastering it. The drawings further disclose variations in such basic method.

THE DRAWINGS

FIG. 1 is a fragmentary perspective view of an existing wall of a room, requiring refinishing.

FIG. 2 is a similar view but showing the wall refinished.

FIGS. 3 & 4 are enlarged cross sectional views as if on lines 3—3 and 4—4 of FIGS. 1 and 2.

Figure 5:
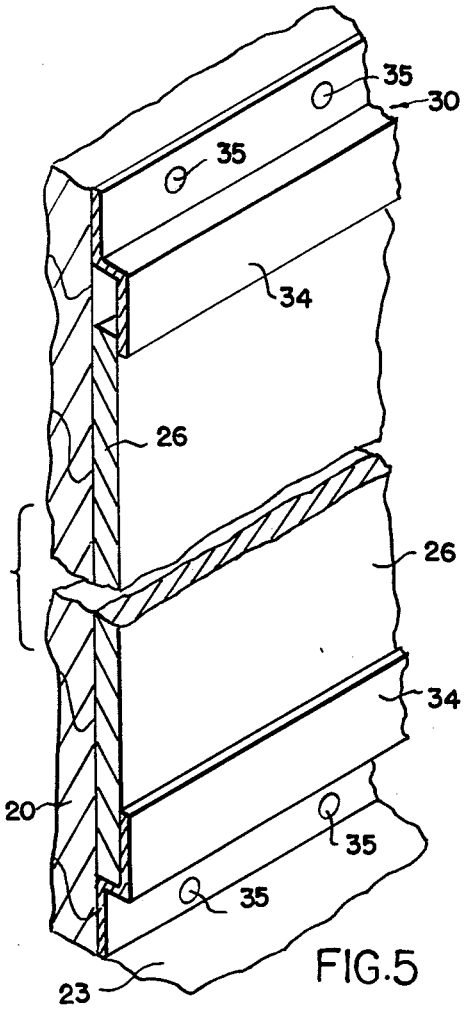

FIG. 5 is a fragmentary broken away perspective view of one form of means used in practicing the method of the invention.

Figure 6:
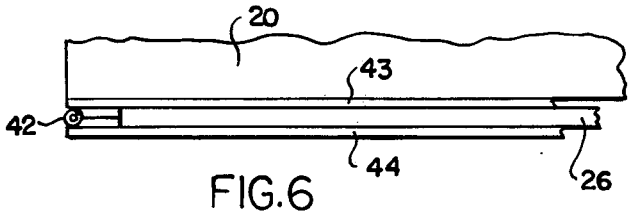

FIG. 6 is a fragmentary sectional view of another form of means used in the present method hereof.

Figure 7:
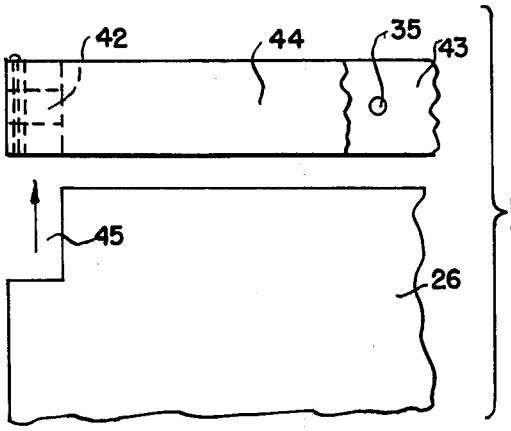

FIG. 7 is an exploded elevational view thereof.

Figure 8:
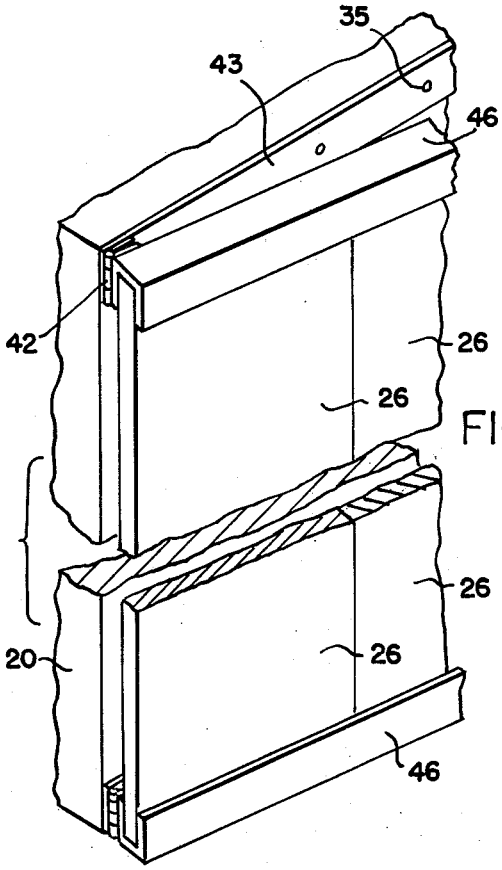

FIG. 8 is a fragmentary perspective view of a pair of opposed articulated channels.

Figure 9:
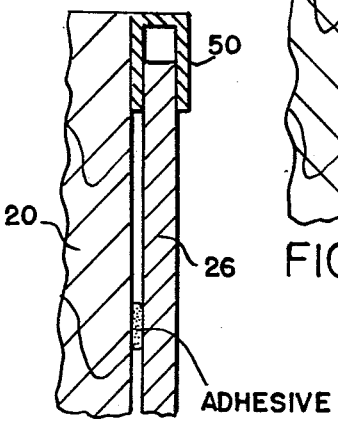
Figure 10:
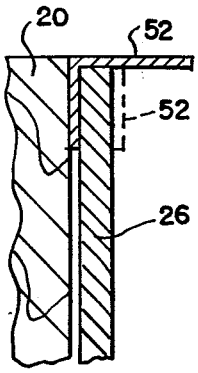

FIGS. 9 & 10 are fragmentary vertical sections showing still other forms of means useful in the method hereof.

It will be understood that the drawings are illustrative only, and are not intended for use as working drawings.

DETAILED DESCRIPTION OF THE INVENTION

Referring to the drawings, it will be seen that FIG. 1 illustrates in sketch form an interior, vertical room wall 20 bounded by a ceiling 21, side walls 22, and a floor 23. Wall 20 is cracked and damaged as by defacements identified at 24.

FIG. 2 shows the same parts as FIG. 1, but with wall 20 now finish-faced by a panel or series of panels 26 according to the method of the invention.

FIGS. 3 and 4 are cross sectional views of FIGS. 1 and 2, showing parts 20–24, studs 27,, opposed wall faces 28, and in the case of FIG. 4, adding the finishing panel 26, and members at 30 for mounting panel 26 in place. The details of members 30 may vary and several illustrative forms are shown in FIGS. 5 through 9 which will now be described in detail.

In FIG. 5, members at 30 are shown as O-gee shaped, thin gauge metal moldings or channels 34, secured at floor and ceiling to wall 20, as by screws or nails 35, for receiving the panel 26.

Such panel is of substantially rigid material such as ply-wood, or of the plastic materials used for counter tops or the like. It has its front face finished as with decorative treatments, wood grain appearance, patterns, etc., all as desired. It is rigid enough to stand free when held at its upper and lower edges, despite that it is of room wall size, height and width, without flexing materially. In various materials, its thickness may vary within a range, found by trial and use, that provides a non-flexing character to the panel when it is mounted. One suitable material would be three-sixteenths inch plywood, wood grain, smooth finish, such as is available in lumber stores. Other suitable materials can readily be found.

The panel, when of room wall size and height, is generally somewhat capable of flexing, so that its vertical dimension may be reduced somewhat when desired, as for a purpose later described.

The panels may be molded. For illustration, the panels may be a laminate of some tripolymer, such as acrilon-nytrile-butadiene-styrene, as a substrate with a thickness of 0.057 to 0.060 inches. Applied thereto is a laminate of an acrylic-patterned material. It may be plain of predetermined color or have a printed design or graining on its obverse side, and a thickness of about 0.003 inches. This material is supplied by Borg Warner Corporation, Dow Chemical Company and others.

The moldings 34 may be thin gauge aluminum or steel, for example, such as is used in shelf edge moldings. Other suitable materials may also readily be found.

In practicing the method of the invention, using the materials above described, and as shown in FIG. 5, the various steps may be practiced in a variety of orders. For example, the moldings 34 may be mounted in place, and then the panel edges may, one by one, be inserted in moldings 34. This may be accomplished by flexing the panel, easy to do when the panel is of room wall height, sufficiently to clear the then free molding. After the first molding has received a panel edge; the second edge of the panel will snap into a second molding, and the panel will be securely and firmly mounted. So mounted, the panel will not flex materially and will accomplish its stated purpose.

The moldings 34 thus are facing channels, though of O-gee form, and the panel edges securely interlock into the mounted channels. Two or more panels 26 may be assembled side by side, FIG. 2.

In another method of practicing the ivention, the second one of the moldings may be mounted after the panel is mounted in the first molding, rather than as above described, wherein both moldings are first mounted and the panel snapped in place.

FIGS. 6 and 7 show a variation wherein a channel for receiving a horizontal edge of a panel 26 is articulated, as by a hinge at 42, to provide rear and front leaves 43–44. In using this form of member, leaf 43 is mounted in any suitable manner on the wall, then leaf 44 is swung out so that the panel 26, preferably notched at 45 for clearance, is set up against leaf 43, and then leaf 44 is swung back in place. Screws or other fasteners, not shown, may be used to latch or secure the two leaves 43–44 to each other firmly to hold the panel 26 securely in place.

Leaves 44 of FIG. 7 may be replaced by downturned and upturned channels 46, as shown in FIG. 8. Said channels are hinged at 42 to leaves 43 anchored at 35 to wall 20. With the channels 46 swung outwardly of the wall, the panels 26 are assembled thereon. Thereafter, the channels are simultaneously swung back to the wall and secured thereto.

FIGS. 9 and 10 show the use of U-shaped channels 50-52 as members for securing the panel in place. Channel 50 of FIG. 9 is non-deformable and it is intended that it be mounted and used without deforming it. Channel 52 contrariwise is first provided in angle cross section as shown in FIG. 10 in full lines, and in use is deformed or bent into U form to hold the panel 26 firmly in place.

Particularly as to the form of panel holding means shown in FIGS. 5 and 6, by way of example, the edges of the panel are interlocked in the channels 34. This is simply done by snapping the somewhat flexible panel of large height into already mounted channels, without further manipulation of the channels or the panel. Alternately, the panels may be forshortened with its top edge first inserted in the top channel until its lower edge clears the lower channel, and dropped into place. Such a panel is removable.

Also, viewing the form of FIGS. 5–6, neither a properly mounted panel, nor the previously mounted channels, may be removed or shifted vertically, without destruction of parts. The mounting, once completed, provides a permanent, secure, stable mounting for the panel, enabling it to function properly as a permanent wall facing.

Replacement and repair of a wall so faced may be accomplished by a later or second application of the process thereof, facing an existing panel faced wall by another panel, in the same way that the original or earlier operation was performed.

If desired, adhesive may also be used, though in many cases the mountings thus far described may be adequate to secure the panel to the wall without objectionable clearance between them. If the clearance exists, or be found objectionable, adhesive may be used, in spots or especially in central areas to improve the mounting, and particularly to reduce clearance and to minimize the already reduced tendency of the panel to flex. In preferred cases the panel will be of sufficient rigidity to present no problem or objection from the points of view of flexing, clearance, etc.

Having described my invention, reference should now be had to the following claims.

I claim:

1. The method of providing a new finish inner face on an existing vertical interior wall of a building or room without painting or papering it and without removing or repairing or replastering it comprising:

applying and securing elongated opposed channel members upon and along the upper and lower edges of the wall inner face at the floor and ceiling respectively;

mounting a facing panel of solid free-standing material by snugly nesting its upper and lower edges within said channels firmly holding the panel so as to snugly bear against the wall face throughout its height and throughout the rear surface of the panel;

the channels being so dimensioned in height with respect to the vertical distance between channels that the channels receive the top and bottom edges of the panels in an interlocking coaction;

hinging the channel members at their one ends to the wall on a vertical axis;

swinging said channels outwardly of the wall;

slidably inserting a series of panels edgewise into said channels at their respective tops and bottoms, aligning said panels edge to edge and swinging the channels and panels into snug registry with the wall.

* * * * *